US005632208A

United States Patent [19]

Weber

[11] Patent Number: 5,632,208

[45] Date of Patent: May 27, 1997

[54] MULTI-AXLE RAILROAD CAR TRUCK

[75] Inventor: Hans B. Weber, Rotonda West, Fla.

[73] Assignee: National Castings Incorporated, Chicago, Ill.

[21] Appl. No.: 557,709

[22] Filed: Nov. 13, 1995

[51] Int. Cl.[6] ..... B61F 5/00

[52] U.S. Cl. ..... 105/182.1; 105/218.1; 105/224.05; 105/196

[58] Field of Search ..... 105/222, 223, 105/224.06, 166, 188, 196, 167, 171, 182.1, 195, 218.1, 219, 220, 224.05

[56] References Cited

U.S. PATENT DOCUMENTS

| | | | |
|---|---|---|---|
| 1,144,329 | 6/1915 | Howard et al. | 105/188 |
| 1,504,252 | 8/1924 | Larsen | 105/188 |
| 1,632,117 | 6/1927 | Charles | 105/166 |
| 1,762,887 | 6/1930 | O'Brien | 105/188 |
| 3,394,662 | 7/1968 | Weber | 105/222 X |
| 5,327,837 | 7/1994 | Weber | 105/226 |

*Primary Examiner*—Mark T. Le

[57] ABSTRACT

A multi-axle railroad car truck or bogie is described as having two very important features; namely, a suspension and snubbing mechanism associated with each axle end to cushion, isolate and dampen vibrations imparted to the axles, and a device for mounting each saddle on an associated pedestal for swinging in a generally vertical plane, such that the axles held captive by the saddles, will each independently move laterally in either of a pair of opposing directions of from 1" to 1¼", measured from a center plane midway between the side frames, when the truck is horizontally disposed in a rest position. Further, the saddles are mounted such that each axle end can move independently in either of a pair of opposing directions of from ⅜" to ½", measured from a fixed vertical plane which includes the longitudinal axis of the axle, when the truck is horizontally disposed in the rest position. Further described is a rigid framework for distributing loads to the axles of a tri-axle truck or bogie.

21 Claims, 4 Drawing Sheets

MULTI-AXLE RAILROAD CAR TRUCK

BACKGROUND OF INVENTION

The invention relates to railroad cars, especially the trucks or bogies used to support the railroad cars as they move along a fixed trackway. More particularly, the invention relates to multi-axle trucks which have two or more axles.

U.S. Pat. No. 3,670,660 discloses a dual axle railroad car truck which is manufactured and sold by National Castings Incorporated of Chicago, Ill. under the trademark SWING MOTION. This particular truck has a pair of parallel twin axles which are carried by a pair of side frames, each of which has a pair of inverted U-shaped pedestals at its opposing ends. The side frames are in vertical, parallel planes, when the truck is in a normally rest position on a horizontal surface or trackway. The SWING MOTION truck has a transversely extending bolster which is swing mounted to the side frames by means of, 1) a rocker seat arrangement, and 2) a suspension and snubbing mechanism which cushions, isolates and dampens undesirable vibrations or motion imparted to the wheels, axles and side frames during operation of the truck, i.e. the side frames can swing or lean out of the aforementioned vertical planes of the side frames during operation of the truck. The opposing ends of the twin axles are held captive in bearings which are carried by adjacent pedestals, so that as the side frames swing or lean, the axles correspondingly move in axial directions or laterally of the longitudinal axis of an attached railroad car or a trackway along which the car is moving. Such lateral movement of the axles helps the truck to better negotiate lateral misalignments of adjacent rails of the trackway and sharp curves in the trackway. Other than manufacturing clearances between the bearing mountings and pedestals, no other lateral or longitudinal motion is provided for the axles of a SWING MOTION truck.

U.S. Pat. No. 3,394,662 discloses a single axle railroad car truck which is manufactured and sold by the above company under the trademark UNITRUCK. This truck has a pair of side frames which are essentially pedestals, as used on the SWING MOTION truck. A saddle is swing mounted in substantially coplanar relation generally within each pedestal by means of, 1) a pedestal rocker seat-adapter arrangement, and 2) a suspension and snubbing mechanism, similar to that used in the SWING MOTION truck. Each of the opposing ends of the single axle is, likewise, held captive in a bearing carried by the adjacent saddle, so that as the saddles swing, lean or tilt out of the plane of the pedestals during operation of the truck, the single axle will correspondingly move axially or laterally of the railroad car and trackway. The pedestals loosely guide the single axle, bearings, rocker seat-adapter arrangements and saddle assemblies in a floating manner, so as to allow and limit the swinging or tilting of the saddles and consequent lateral motion of the axle. Moreover, the pedestals allow and limit a predetermined and controlled amount of longitudinal motion of the saddles and consequent longitudinal movement of the axle to facilitate passive steering of the axle. The technology of the '662 patent has been limited solely to single axle railroad car trucks which are used, for example, on unit trains or railroad cars which employ only two axles.

Railroad cars built today are expected to carry bigger and heavier loads than ever before. For example, railroad cars are designed to carry truck trailers and packaged containers. As a result, railroad cars are made bigger, especially longer, and sometimes with heavy structural bodies, thereby creating new problems for those associated with the railroad industry. For example, because of the increased length of newer railroad cars, the railroad car trucks are now spaced farther apart to where lateral movement and passive steering of the truck axles has become critical to the safe negotiation of small radius curves which presented no problems for the shorter cars built in the past. Heavier loading of railroad cars causes two problems; namely, the need for greater support and better weight distribution on the axles, so as not to damage or destroy the trackway or underlying road bed of the trackway. To meet the first of these two problems, conventional dual axle trucks have been beefed up to increase their strength, and longer, stronger tri-axle trucks are being built to support and better distribute the heavier loads to the trackway and track bed. The invention is in an improved multi-axle truck which is designed to more easily accommodate these larger railroad cars and better negotiate the shorter radius curves of existing railroad trackways.

Briefly stated, the invention is in a multi-axle railroad car truck wherein one or more bolsters are rigidly secured between a pair of side frames which carry two or more axle and wheel assemblies. Moreover, each of the axles is designed to move laterally independently of the other axles from 1" to 1¼", measured in either of two opposing directions from a vertical plane midway between the side frames, when the truck is in a normal rest position on a horizontal surface or trackway, or an overall distance of from 2" to 2½" as compared to the axles of most conventional trucks which am capable of moving laterally only about ⅛" in either direction from such vertical plane. Further, each of the axles is permitted a controlled longitudinal motion which effectively increases passive steering of the axles.

Another aspect of the invention is in the provision of each of the axle ends with its own, independent suspension and motion dampening or snubbing mechanism, contrary to the majority of existing dual or tri-axle railroad car trucks which are provided with a single suspension and motion dampening mechanism only at each end of the bolster of the railroad car truck.

It can be appreciated by those skilled in the art that such lateral and longitudinal relative movement between the axles and pedestals makes it much easier for the truck to adjust to variations in the trackway or small radius curves which, otherwise, may be perilous to negotiate without derailment.

DESCRIPTION OF DRAWING

The following description of the invention will be better understood by having reference to the accompanying drawing, wherein.

DETAILED DESCRIPTION OF DRAWING

Figure 1:
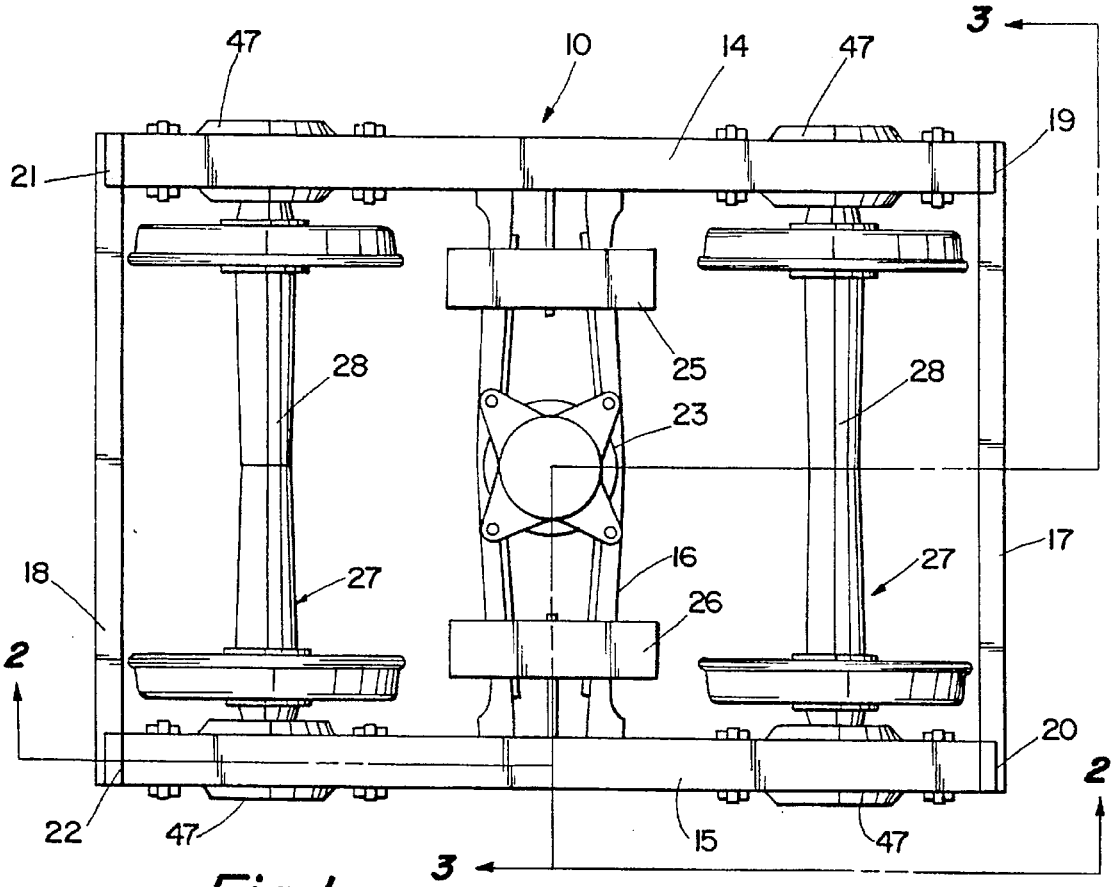
FIG. 1 is a plan view of a dual axle railroad car truck which is made in accordance with the invention.
Figure 3:
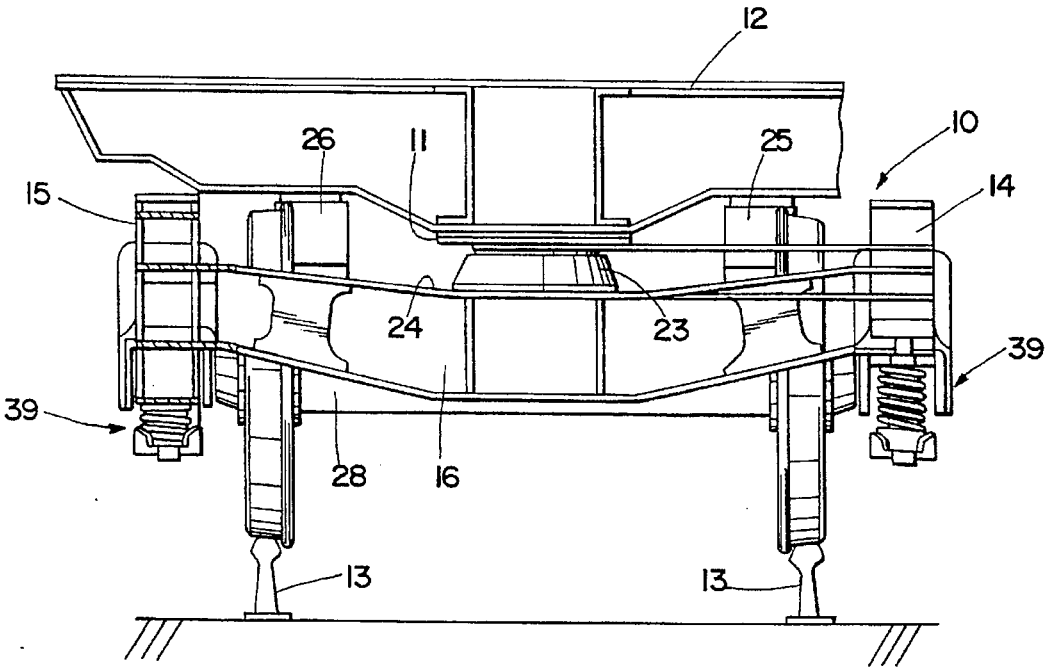
FIG. 3 is a partial section and end view of the dual axle truck, as seen from the line 3—3 of FIG. 1.
Figure 2:
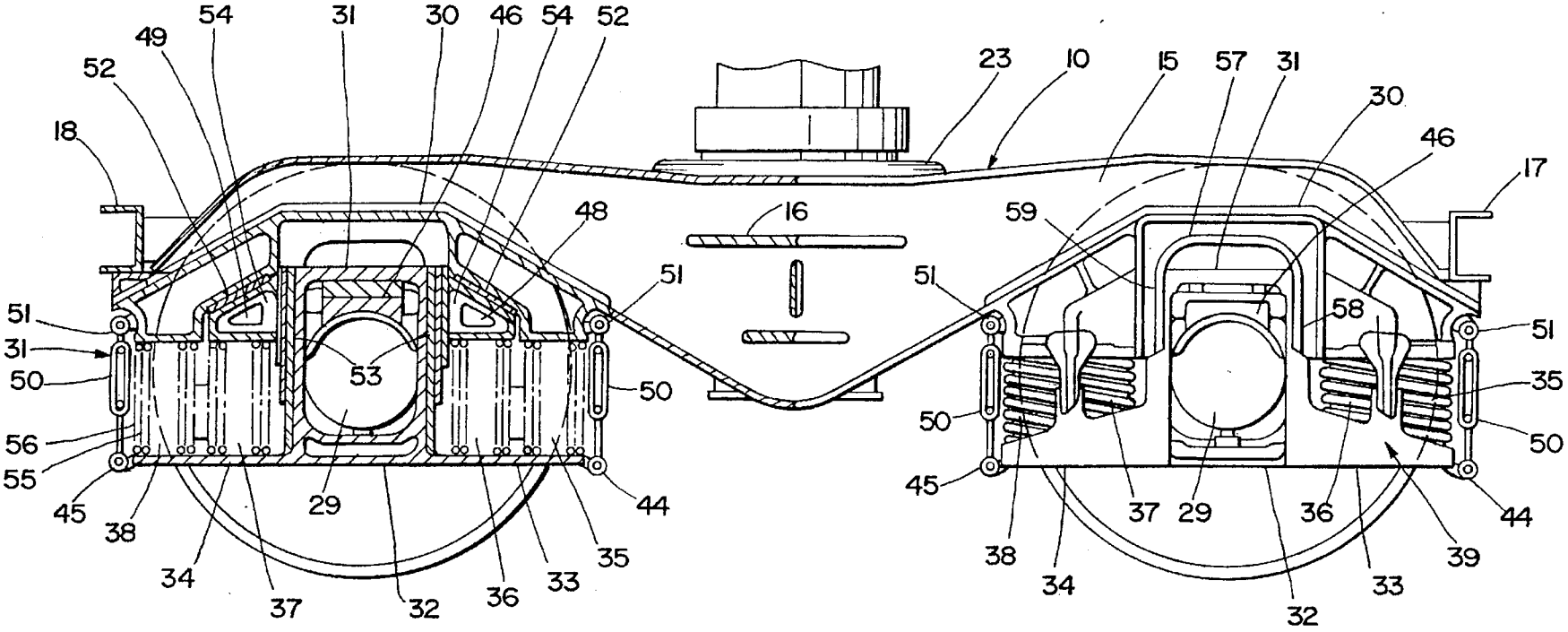
FIG. 2 is a partial section and side view of the dual axle truck, as seen from the line 2—2 of FIG. 1.

With general reference to the drawing for like parts, and particular reference to FIGS. 1–3, there is shown a multi-axle railroad car truck 10 which, for explanation and claiming purposes, is assumed to be in a horizontal position as it would be, if it were mounted on the underside 11 of a railroad car 12 on a horizontal trackway 13.

The truck 10 is a dual axle truck which essentially comprises a pair of rigid side frames 14 and 15, which are held in parallel relation by a single, rigid bolster 16 which is secured to the side frames 14 and 15 in transverse relation, and a pair of rigid channel or O-shaped members 17 and 18, which are secured between the opposing ends 19,20 and 21,22 of the side frames 14,15.

The bolster 16 can be box shaped between a pair of I-shaped opposing ends, as described in U.S. Pat. No. 5,327,837. The bolster 16 carries a pivot mounting 23 which is located on the top side 24 of the bolster 16 midway between the side frames 14 and 15 for attachment to the underside 11 of the railroad car 12, such that the dual axle truck 10 is free to rotate to follow curves in the trackway 13. The bolster 16 also carries a pair of solid or resilient side bearings 25 and 26 which are equally spaced from the pivot mounting 23 to engage and help support the railroad car 12 in upright relation and prevent the railroad car 12 from leaning or tilting on a pair of trucks 10.

A pair of similar wheel and axle assemblies 27, including a pair of twin axles 28 with opposing ends 29, are disposed between the side frames 14 and 15 in parallel relation with the bolster 16, and are carried by the side frames 14 and 15, as they move along the trackway 13.

An inverted, generally U-shaped pedestal 30 is secured at each of the opposing ends 19,21 and 20,22 of the side frames 14 and 15 and extends downward from the side frames 14 and 15 in the direction of the trackway 13 below. The pedestals 30 are similar, in design, and can be integrally cast with the side frames 14 and 15 into what are known as pedestal side frames if desired. Each pedestal 30 is designed to receive in coplanar relation, a vertically elongated housing 31 of a saddle 32 which is independent of the pedestal 30.

The elongated housing 31 extends vertically from a pair of coplanar horizontal flanges 33 and 34 which extend laterally from the housing 31 and act as spring seats for four sets 35–38 of coil springs which are part of four separate suspension and snubbing mechanisms 39 that are associated with the four axle ends 29 to independently cushion, isolate and dampen vibrations or movement imparted to each axle end 29 of the twin axles 28 of the dual axle truck 10 by misaligned adjacent rails of the trackway 13, so that such movement will not be transmitted to the railroad car 12 via the saddles 32, pedestals 30, side frames 14 and 15, and bolster 16. The spring seat flanges 33 and 34 extend beyond the outboard sets 35 and 38 of coil springs, farthest spaced from the axle end 29, and terminate at a pair of opposing ends 44 and 45.

Each saddle housing 31 is designed to receive and/or support a pedestal rocker seat-adapter arrangement 46 and an axle bearing 47 which, in turn, rotatably receives the adjacent end 29 of each of the twin or dual axles 28.

Each suspension and snubbing mechanism 39, as previously indicated, includes four sets 35–38 of coil springs, the outboard sets 35 and 38 of coil springs being suspension springs which are vertically disposed between the spring seat flanges 33 and 34 and the adjacent pedestal 30, and the inboard sets 36 and 37 of coil springs, closest spaced to the adjacent axle end 29, being vertically disposed between the spring seat flanges 33 and 34 and a pair of oppositely disposed, triangular wedges 48 and 49. The outboard and inboard sets 35,38, and 36,37, of coil springs are maintained in predetermined compressed relation by any suitable means, e.g. a pair of similar, adjustable length links 50 which connect the opposing ends 44 and 45 of the saddle flanges 33 and 34 with vertically adjacent portions 51 of the pedestals 30. The links 45 also keep the pedestals 30 and saddles 32 together and prevent separation of the axle sets from the truck 10. Accordingly, the triangular wedges 48 and 49 are spring loaded by the inboard sets 36 and 37 of coil springs against correspondingly disposed, flat wear plates 52 and 53 that are secured, respectively, to the pedestal 30 and vertically elongated housing 31 of the saddle 32. The wear plates 52 and 53 form between them correspondingly shaped wedge pockets 54 for receiving the wedges 48 and 49.

Each of the sets 35–38 of coil springs includes an inner coil spring 55 and an outer, surrounding coil spring 56 of greater length, such that the initial resistance and snubbing action of the suspension and snubbing mechanism 39 will be softer and increase dramatically when the inner coil spring 55 comes into play.

The saddles 32 are each mounted below an adjacent pedestal 30 in a loosely guided floating manner. The vertical housing 31 of each saddle 32 extends upwardly into the inverted U-shaped frame 57 of the adjacent pedestal 30, and is supported therein by the rocker seat-adapter arrangement 46 on the bearing 47 which is mounted on the end 29 of each one of the twin axles 28. The vertical housings 31 are laterally restrained within the inverted U-shaped pedestal frames 57 by the inboard sets 36 and 37 of coil springs acting through the wedges 48 and 49. As previously described in connection with the UNITRUCK single axle truck, the saddles 32 can swing or tilt from their normal vertical coplanar relationship with the pedestals 30, to cause lateral movement of each axle, independent of the other axle, of from one to one and one-quarter inches (1" to 1¼"), measured in either of two opposing directions from a vertical plane which is equally spaced from, and parallel to, the side frames 14 and 15 when they are vertically disposed in a rest position, to provide overall lateral movement of from two to two and one-half inches (2" to 2½"), as distinguished from the axles of many existing dual axle trucks where such axles, because of close manufacturing tolerances, are restricted to lateral movement of only about one-eighth of an inch (⅛") in either direction from a similar vertical plane, or substantially less than the lateral movement of the twin axles 29 of the new improved railroad car truck 10 of the invention. Moreover, the predetermined clearances provided between each vertical housing 31 and adjacent vertical sides or guide arms 58 and 59 of the inverted U-shaped pedestal 30, allows each of the axle ends 29 to move independently of the other axle ends 29 in longitudinal directions towards and away from the opposing axle end 29 on the same side frame, a distance of from three eights of an inch to one-half of an inch (⅜" to ½"), measured in either direction from the vertical center planes of the pedestals 30, when the dual axle truck 10 is in a normal vertically disposed, unloaded rest position, so that the overall longitudinal movement is from three-quarters of an inch to one inch (¾" to 1") to increase passive steering of the dual axle truck 10. Thus, the dual axles 28 are capable of moving independently, laterally and longitudinally of the railroad car 12 and trackway 13 to better negotiate rail misalignments and sharply angled curves of the trackway 13.

Figure 4:
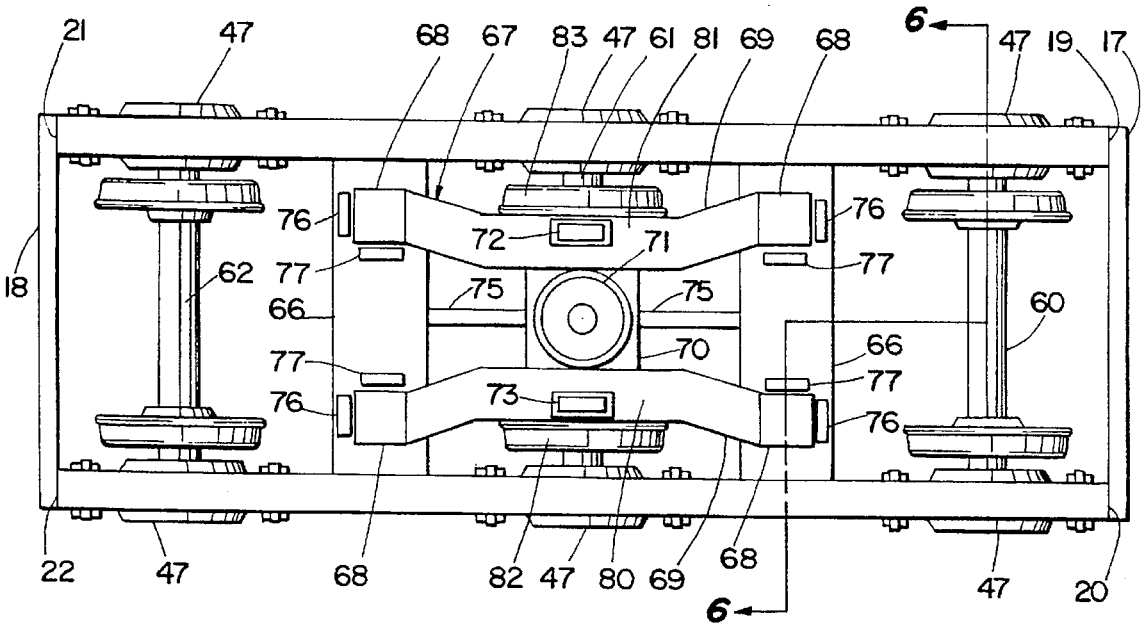
FIG. 4, is a plan of a tri-axle railroad car truck which is made in accordance with the invention.
Figure 6:
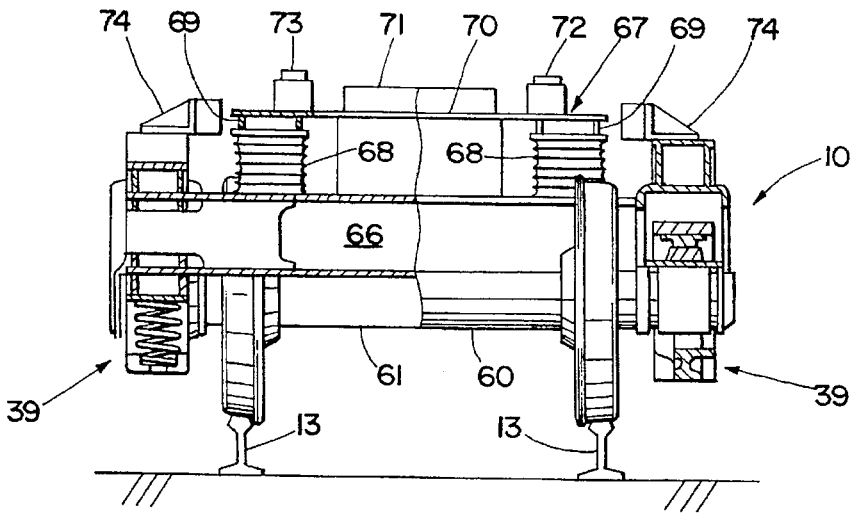
FIG. 6 is a partial section and end view of the tri-axle truck, as seen from the line 6—6 of FIG. 4.
Figure 5:
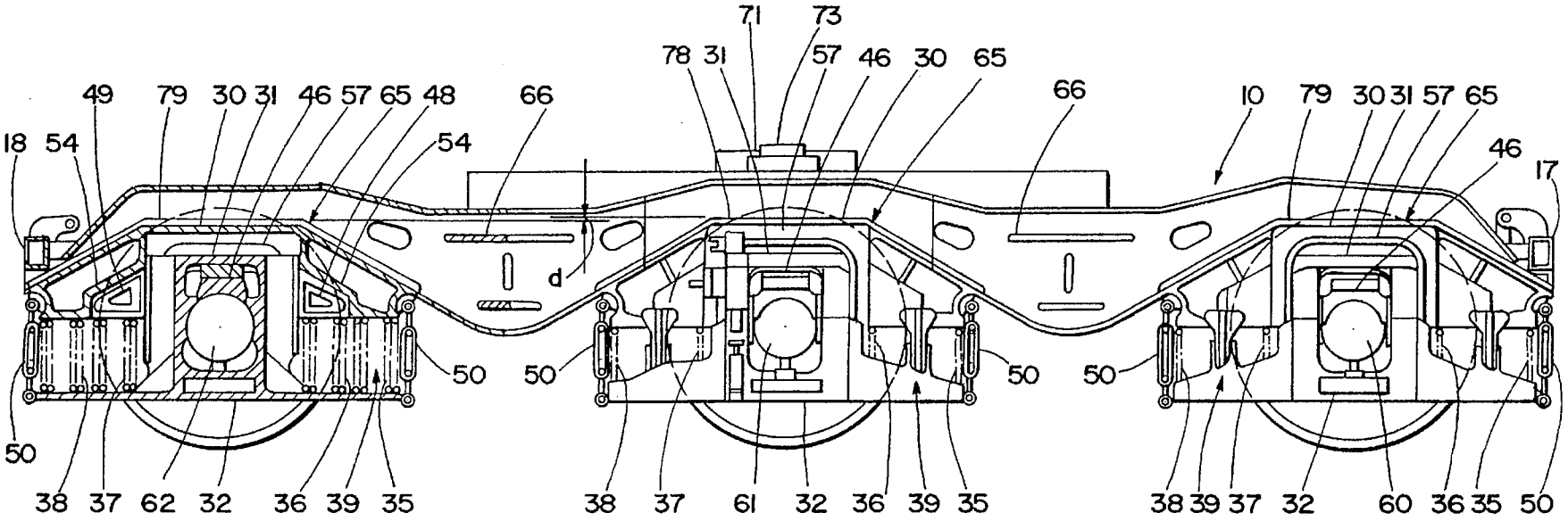
FIG. 5 is a partial section and side view of the tri-axle truck, as seen from the line 5—5 of FIG. 4.

With particular reference to FIGS. 4–6, the multi-axle truck 10 shown is a tri-axle railroad car truck which employs three axles 60–62; namely, a front axle 60, a rear axle 62, and an intermediate or center axle 61. The tri-axle truck 10 comprises a pair of side frames 63 and 64 which are sufficiently long to accommodate three axle assemblies 65 which are similar in design and identically spaced longitudinally on each of the side frame 63 and 64. A pair of twin bolsters 66, similar to the one previously described in connection with the dual axle truck, are secured to, and between, the side frames 63 and 64 in transverse, parallel relation.

The axle assemblies 65 each include the previously described components of a pedestal 30, a swing mounted saddle 32, a suspension and snubbing mechanism 39, a rocker seat-adapter arrangement 46, and an axle bearing 47, to allow the axles 60–62 to move independently both in the aforementioned lateral and longitudinal directions.

It can be appreciated by those skilled in the art, that one of the problems in a truck the size of a tri-axle truck 10, involves the distribution of the weight of the railroad car 12 to the three axles 60–62. The following framework 67 is designed to, as best as possible, evenly distribute weight to the three axles 60–62. Firstly, the twin bolsters 66 are disposed midway between the front and center axles 60,61, and the center and rear axles 61,62, as best seen in FIG. 5.

Should it be desirable to provide the weight distribution (WD) framework 67 with a load cushioning device, then four similar, resilient elastomeric cushion pads 68 with parallel metal plates embedded therein, can be secured atop the twin bolsters 66 in rectangular, upstanding relation for supporting a pair of similar, but oppositely disposed, rigid beams 69 which are the base of the WD framework 67 and which would, otherwise, be secured directly to the twin bolsters 66. In either case, the twin beams 69 span the distance between the twin bolsters 66 and extend longitudinally between the side frames 63 and 64 in equally spaced relation from the side frames 63 and 64.

A rigid, pivot support beam 70 is secured between the twin beams 69 in crosswise relation to the side frames 63 and 64 directly above the center axle 61, and is provided, midway between the side frames 63 and 64, with a center pivot 71 which is designed to be pivotally mounted to the underside 11 of a railroad car 12. The center pivot 71 can be flat, American style, or spherical, European style, depending on where the tri-axle truck 10 will be used. The pivot support beam 70 is provided with a plurality of side bearings 72 and 73 which are equally spaced from the center pivot 71 to help support the railroad car 12 and prevent it from leaning or tipping, as previously mentioned. The twin bolsters 66 and rigidly mounted WD framework 67 is commonly known as a "spanbolster".

There is no problem rotating the tri-axle truck 10 about a vertical axis which passes through the center of the middle or center axle 61, when a rigid spanbolster is used, However, it is necessary to stabilize the rigid WD framework 67, when it is resiliently mounted on the elastomeric cushion pads 68. This is accomplished by the provision of a plurality of similar, lateral stops 74 to engage the longitudinal twin beams 69 between them and prevent lateral movement of the rigid WD framework 67, in combination with one or more traction rods 75 which connect the resiliently mounted, rigid WD framework 67 to the tri-axle truck 10 at approximately the centerline of the three axles 60–62, to transmit longitudinal traction and braking forces to the beams 69 and 70. A plurality of longitudinally and laterally spaced stop blocks 76 and 77 are mounted on the twin bolsters 66 to engage the resilient cushion pads 68 and maintain them in secured relation atop the twin bolsters 66. These stop blocks 76 and 77 can be made larger to restrict longitudinal and lateral movement of the rigid framework 67, if desired.

The horizontally disposed, top sides 78 of the opposing pedestals 30 of the center axle 61 are made a distance d of about five eights of an inch (⅝") higher than the corresponding, horizontally disposed top sides 79 of the pedestal frames 30 of the front and rear axles 60,62, to allow for greater deflection of the side frames 63 and 64 between the front and rear axles 60,62, caused by the heavier loads imposed on the side frames 63 and 64 in the areas of the center axle 61.

The longitudinal twin beams 69 have parallel center sections 80 and 81 which are laterally offset inwardly towards each other to vertically expose the wheels 82 and 83 of the center axle 61, to lower the rigid WD framework 67 as much as possible, so that the railroad car 12 will be closer to the tri-axle trucks 10.

Thus, there has been described a unique, highly improved multi-axle railroad car truck or bogie which has a separate suspension and motion dampening mechanisms for each axle end in combination with swing mounting the axle receiving saddles which allows greater lateral and longitudinal movement of each of the truck axles independent of the other axles, whereby tighter curve negotiation without derailment is possible.

What is claimed is:

1. A multi-axle railroad car truck, comprising:

a) a pair of rigid, integral side frames, each of which has a pair of opposing ends, the pair of side frames being equally spaced from a parallel, vertical center plane, when the truck is resting on a horizontal surface;

b) at least one rigid bolster disposed transversely between the side frames, the at least one bolster having a pair of opposing ends which are rigidly secured to the side frames and hold the side frames in parallel relation, the at least one bolster and side frames forming a generally H-shaped rigid truck frame;

c) at least one pair of rigid pedestals carried by each side frame adjacent the opposing ends thereof in coplanar relation therewith, the pedestals of one of the pair of side frames being oppositely and transversely aligned with the pedestals of the other of the pair of side frames;

d) a rigid saddle associated with each pedestal and disposed therein in generally coplanar relation with each associated pedestal, each saddle carrying a bearing;

e) an elongated axle and pair of flanged wheels disposed between each opposing pair of pedestals, each axle having a pair of opposing ends which are rotatable in the bearings carried by the saddles; and f) means for mounting each axle for limited axial movement in two opposing directions independent of the other axles, said means including means for mounting each saddle for independent swinging motion in and out of coplanar relation with an adjacent, associated pedestal, such that the bearings and axle ends, captured therein, are capable of moving axially of the axles and laterally of the side frames and center plane between them, at least one inch measured in either of two opposing directions from the center plane for an overall reciprocating lateral movement of at least two inches.

2. The multi-axle railroad car truck of claim 1, wherein the saddle mounting means, includes:

g) a suspension and snubbing mechanism disposed between each pedestal and associated saddle to cushion, isolate and dampen motion imparted to the saddles via the wheels and axles.

3. The multi-axle railroad car truck of claim 2, wherein the saddle mounting means includes mounting each saddle such that each of the opposing ends of each axle can independently move longitudinal of the side frames of from ⅜" to ½" measured in either of two opposing directions from a vertical center plane of each pedestal, to enhance passive steering of the multi-axle truck.

4. The multi-axle railroad car truck of claim 3, wherein each pedestal has an inverted U-shape and each saddle, includes:

h) a vertically elongated housing disposed in each inverted U-shaped pedestal, each housing being designed to receive, i) a rocker seat-adapter arrangement, and ii) an axle bearing for rotatably receiving an adjacent end of an axle, each housing having a pair of coplanar flanges which extend laterally from the housing in parallel relation with the adjacent side frame.

5. The multi-axle railroad car truck of claim 4, wherein each suspension and snubbing mechanism, includes:

j) an outboard set of resilient springs disposed vertically between each pedestal and the flanges of an associated saddle;

k) a pair of oppositely disposed, triangular wedges disposed in correspondingly shaped pockets which are formed between each pedestal and the housing of an associated saddle on either side of the housing; and m) an inboard set of resilient springs disposed along side of the outboard set of springs in vertical relation between the flanges of an associated saddle and the wedges, the inboard set of springs being closer to an adjacent axle end than the outboard set of springs.

6. The multi-axle railroad car truck of claim 5, wherein the means mounting each of the saddles for swing motion, includes:

n) at least one pair of adjustable length links connecting each pedestal with the flanges of an associated saddle, the links being designed to, i) maintain the inboard and outboard sets of springs in predetermined compressed relation, to spring load the wedges and saddles, and ii) allow at least the housings of the saddles to swing in either direction out of the plane of the associated pedestal and side frame.

7. The multi-axle railroad car truck of claim 6, wherein there are two axles and one bolster extending transversely between the side frames.

8. A multi-axle railroad car truck, comprising:

a) a pair of rigid side frames, each of which is integral and has a pair of opposing ends, the pair of side frames being equally spaced from a parallel, vertical center plane, when the truck is resting on a horizontal surface;

b) at least one pair of rigid, bolsters disposed transversely between the side frames in parallel relation, each of the at least one pair of bolsters having a pair of opposing ends which are rigidly secured to the side frames and hold the side frames in parallel relation, the at least one pair of bolsters and side frames forming a generally H-shaped rigid truck frame;

c) at least three rigid pedestals carried by each side frame in coplanar relation therewith, the at least three pedestals carried by each side frame being spaced such that two of the three pedestals are outer pedestals which are adjacent the opposing ends of the side frame and the third of the three pedestals is an inner pedestal which is equally spaced between the other two pedestals, the at least three pedestals of one of the pair of side frames being oppositely and transversely aligned with the at least three pedestals of the other of the pair of side frames, the inner and outer pedestals of each side frame being equally spaced from the bolster ends therebetween;

d) a rigid saddle associated with each pedestal and disposed therein in coplanar relation therewith, each saddle carrying a bearing;

e) an elongated axle and pair of flanged wheels disposed between each pair of oppositely aligned pedestals, each axle having a pair of opposing ends which are rotatable in the bearings carried by the saddles;

f) means for mounting each axle for limited axial movement in two opposing directions independently of the other axles, said means including means for mounting each saddle for independent swinging motion in and out of coplanar relation with an adjacent, associated pedestal, such that the bearings and the axle ends, captured therein, are capable of moving axially of the axles and laterally of the side frames and the center plane, at least one inch, measured in either of two opposing directions from the center plane, for an overall reciprocating lateral movement of at least two inches; and g) means supported on the at least one pair of bolsters for mounting the at least one pair of bolsters and attached side frames for unitary rotation on a railroad car, when the truck is mounted in supporting relation under a railroad car.

9. The multi-axle railroad car truck of claim 8, wherein the saddle mounting means includes;

g) a suspension and snubbing mechanism disposed between each pedestal and associated saddle to cushion, isolate and dampen motion which is imparted to the saddle via the wheels and axles; and h) means for mounting each saddle such that the bearings and the axle ends, captured therein, are capable of moving independently and longitudinally of the side frames at least three-eighths inches measured in either of two opposing directions from a vertical center plane of each pedestal to enhance passive steering of the multi-axle truck.

10. The multi-axle railroad car truck of claim 8, wherein each pedestal has an inverted U-shape and each saddle includes:

j) a vertically elongated housing disposed in each inverted U-shaped pedestal, each housing being designed to receive, i) a rocker seat-adapter arrangement, and ii) an axle bearing for rotatably receiving an adjacent end of an axle, each housing having a pair of coplanar which extend laterally from the housing in parallel relation with the adjacent side frame; and wherein each suspension and snubbing mechanism includes:

k) an outboard set of resilient springs disposed vertically between each pedestal and the flanges of an associated saddle;

l) a pair of oppositely disposed, triangular wedges disposed in correspondingly shaped pockets which are formed between each pedestal and the housing of an associated saddle on either side of the housing; and m) n inboard set of resilient springs disposed along side of the outboard set of springs in vertical relation between the flanges of an associated saddle and the wedges, the inboard set of springs being closer to an adjacent axle end than the outboard set of springs; and wherein the means mounting each of the saddles for swing motion, includes:

n) at least one pair of adjustable length links connecting each pedestal with the flanges of an associated saddle, the links being designed to, iii) maintain the inboard and outboard sets of springs in predetermined compressed relation, to spring load the wedges and saddles, and iiii) allow at least the housings of the saddles to swing in either direction out of the plane of the associated pedestal and side frame.

11. The multi-axle railroad car truck of claim 10, wherein the means for mounting the bolsters and side frames for unitary rotation includes a rigid framework disposed in supported relation atop the bolsters, the framework, including:

q) a pair of rigid beams spanning the bolsters in longitudinal relation with the side frames, the beams being equidistant from the side frames.

12. The multi-axle railroad car truck of claim 11, wherein the framework, includes:

r) a third, rigid beam secured to, and spanning the parallel beams in supported relation thereon, the third beam being vertically aligned with the center axle, when the truck is in a normal horizontal rest position; and s) a pivot mounting carried by the third beam midway between the side frames for pivotal attachment to the underside of a railroad car.

13. The multi-axle railroad car truck of claim 12, which includes at least one pair of side bearings atop the third beam in equally spaced relation from the pivot mounting to help stabilize the railroad car on the tri-axle truck.

14. The multi-axle railroad car truck of claim 13, wherein the vertically highest portions of the pedestals aligned with the center axle, is about ⅝" above the corresponding portions of the pedestals aligned with the front and rear axles, to compensate for greater deflection of the side frames in the area of the center axle.

15. The multi-axle railroad car truck of claim 14, wherein the pair of rigid longitudinal beams are secured to the bolsters.

16. The multi-axle railroad car truck of claim 14, which includes a plurality of resilient cushion pads interposed between the bolsters and rigid longitudinal beams, such that the rigid framework is resiliently mounted on the bolsters.

17. The multi-axle railroad car truck of claim 16 wherein the cushion pads are composed of elastomer material with parallel metal plates embedded therein.

18. The multi-axle railroad car truck of claim 17, which includes means coacting between the truck and rigid framework for stabilizing the framework on the resilient cushion pads.

19. The multi-axle railroad car truck of claim 18, wherein each bolster includes a box-shaped configuration between a pair of opposing ends which are I-shaped.

20. The multi-axle railroad car truck of claim 7, wherein the bolster includes a box-shaped configuration between a pair of opposing ends which are I-shaped.

21. The multi-axle truck of claim 11, wherein the pair of rigid beams include parallel center sections which are laterally offset inwardly towards each other to vertically expose wheels of the center axle.

* * * * *